United States Patent [19]

Ellsberg

[11] 4,158,874

[45] Jun. 19, 1979

[54] SAFETY INTERLOCK SYSTEM

[75] Inventor: Thomas R. Ellsberg, North Hollywood, Calif.

[73] Assignee: C.P.P.L., Inc., Los Angeles, Calif.

[21] Appl. No.: 896,468

[22] Filed: Apr. 14, 1978

Related U.S. Application Data

[63] Continuation-in-part of Ser. No. 709,314, Jul. 28, 1976, abandoned.

[51] Int. Cl.[2] ..... E05B 49/00

[52] U.S. Cl. ..... 361/172; 307/10 AT; 340/147 MD

[58] Field of Search ..... 361/171, 172; 340/164, 340/147 MD, 147 CN; 70/278; 307/10 AT; 180/114

[56] References Cited

U.S. PATENT DOCUMENTS

| | | | |
|---|---|---|---|
| 3,691,396 | 9/1972 | Hinrichs | 361/172 X |
| 3,710,316 | 1/1973 | Kromer | 361/172 X |
| 3,718,202 | 2/1973 | Brock | 361/172 X |
| 3,754,148 | 8/1973 | Nye | 361/172 X |
| 3,755,776 | 8/1973 | Kotras | 361/172 X |
| 3,784,839 | 1/1974 | Weber | 361/172 X |
| 3,796,889 | 3/1974 | Fradkin et al. | 361/172 X |
| 3,805,246 | 4/1974 | Colucci et al. | 340/164 R X |

*Primary Examiner*—Harry E. Moose, Jr.

*Attorney, Agent, or Firm*—Romney, Schaap, Golant, Scillieri, Disner & Ashen

[57] ABSTRACT

A safety interlock system for automotive vehicles and like devices which have an electrically-operable component forming part of the engine of said vehicle or like device. The safety interlock system comprises a plurality latches in the form of integrated circuits which can only be operated in pre-established sequence with a pre-established code of indicia. When the latches are opened pursuant to the pre-established code with inputs in proper sequence from a plurality of manually operable input switches, the interlock system will be enabled thereby permitting operation of the electrically operable component and hence said engine. Suitable forms of time delays are provided to enable operation of said engine by others for pre-established time delay periods and controlled delay conditions.

23 Claims, 5 Drawing Figures

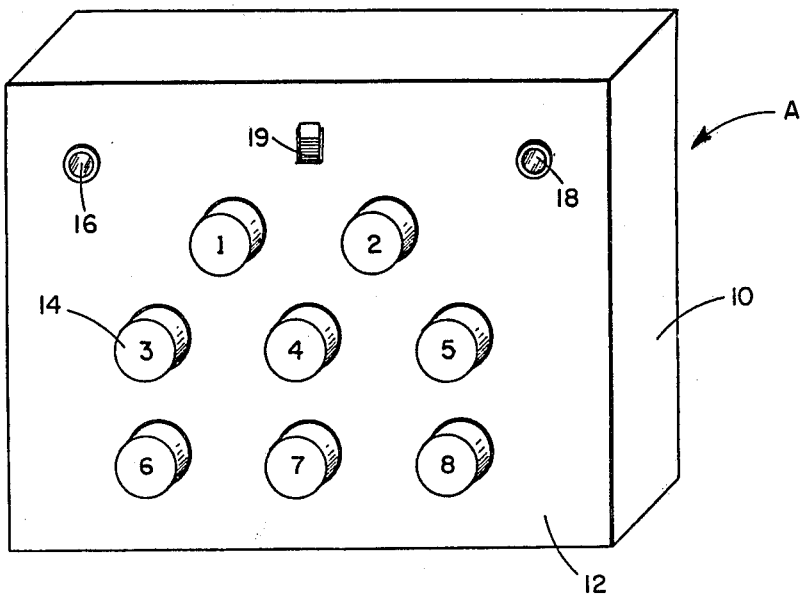
FIG. 1
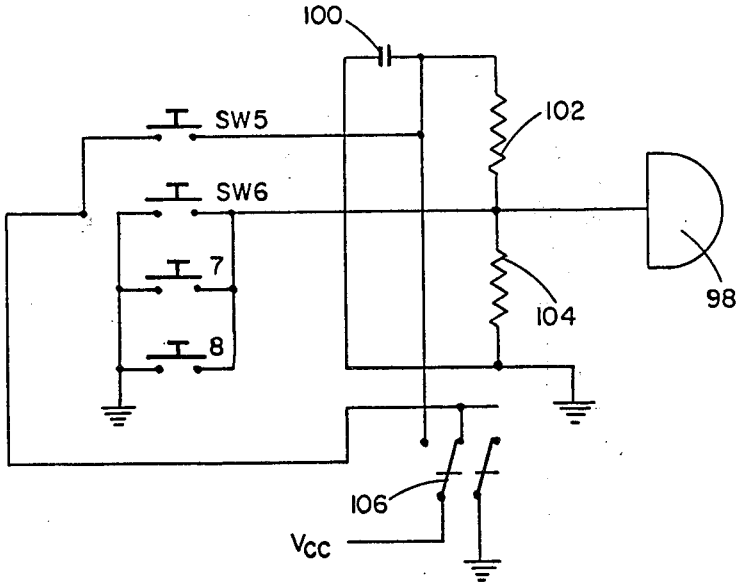
FIG. 4
TRUTH TABLE FOR 1 OF 4 LATCHES
| | R | S | Q |
|---|---|---|---|
| $L_1$ | 1 | 1 | NO CHANGE |
| $L_2$ | 1 | 0 | 1 |
| $L_3$ | 0 | 1 | 0 |
| $L_4$ | 0 | 0 | 0 |
FIG. 5

SAFETY INTERLOCK SYSTEM

RELATED APPLICATION

This application is a continuation-in-part of my copending application Ser. No. 709,314 filed July 28, 1976 for Safety Interlock System now abandoned.

BACKGROUND OF THE INVENTION

This invention relates in general to certain new and useful improvements in safety interlock systems and, more particularly, to safety interlock systems which are especially designed to prevent theft or other unauthorized removal of automotive vehicles and like apparatus.

In recent years, theft of automotive vehicles has become quite prevalent and, in fact, has given rise to large-scale businesses based on stealing and resale of such automotive vehicles. In order to obviate this problem, various manufacturers of automotive vehicles and, in addition, various suppliers of safety systems and theft-prevention systems and the like have proposed alarm systems for use in these vehicles which advise of the potential theft or otherwise unauthorized removal of the vehicle. These alarm systems generally rely upon electronic sound alarms which are generated upon unauthorized attempts of removal. However, one skilled in these particular alarm systems is capable of short-circuiting the alarm system or otherwise removing the vehicle in such manner as to obviate the generation of the alarm signal.

There has been at least one proposal which utilizes an encoded switching system which must be actuated prior to operation of the vehicle. This encoded switch system essentially operates in the same manner as a combination switch which is designed to prevent operation of the vehicle until such time as the proper combination has been introduced into the switch to energize the same and in order to thereby operate the vehicle. While this interlock system certainly provides many advantages over the alarm system, these interlock systems are quite deficient in many respects. One of these deficiencies resides in the fact that these interlock systems can be easily obviated by one skilled in the art of unauthorizedly removing vehicles and the like. Furthermore, the conventionally available interlock systems are easily rendered ineffective by quickly determining the code through electrical signal measurements in the operation thereof.

In accordance with the safety switching systems of the type presently proposed, these systems rely upon a plurality of push buttons, or other switching inputs, which are actuated in order to produce a certain number of signals in proper sequence in order to open the interlock to thereby permit the starting of the vehicle. However, these systems utilize discrete components and, in addition, are designed so that one skilled in basic electronics can easily determine the encoding of the switching interlock. These systems utilize R-S flip-flops which operate silicon controlled rectifier circuits and which permit operation of the starter solenoid of a vehicle. In addition, these systems may also be connected to other components of the vehicle such as the fuel pump. However, these systems which use the discrete components are so designed in order to permit the energization of the vehicle, are also capable of having their coding easily detected, since the components of the circuit generally provide a 10–15-milliamp current. One skilled in the art of a basic electronic meter can easily detect the code by merely pressing the push button switches in order to determine the proper coding to operate the vehicle. Moreover, a relative inexpensive gauge can be used in a very short time by one basically informed in the use of this system so that the system has been quickly obviated.

OBJECTS OF THE INVENTION

It is, therefore, the primary object of the present invention to provide a safety interlock system which is designed for use with powered vehicles and the like that permits operation of the vehicles or like systems only by having full knowledge of a code which operates the interlock system.

It is another object of the present invention to provide a safety interlock system of the type stated which operates on the basis of a knowledge of a code operated by a plurality of manually operable input switches in order to open the safety interlock to permit operation of the vehicle or like system.

It is a further object of the present invention to provide a safety interlock system of the type stated which is uniquely designed in such manner that the encoding thereof cannot be determined by conventional metering techniques.

It is an additional object of the present invention to provide a method of actuating a safety interlock system in such manner that the interlock system can only be opened by having knowledge of the encoding designed to open the interlock and which thereby obviates unauthorized removal of any device upon which the interlock system is utilized.

It is another salient object of the present invention to provide a method of manufacturing an interlock system of the type stated which can be made at a low unit cost on a mass production basis.

With the above and other objects in view, my invention resides in the novel features of form, construction, arrangement and combination of parts presently described and pointed out in the claims.

GENERAL DESCRIPTION

The present invention relates in general to a unique safety interlock system to prevent theft or unauthorized removal of a vehicle having an engine system for powering the vehicle. This vehicle would also be equipped with an electrical component in an electrical circuit associated with the engine system, and where the electrical component is a part of the engine's system.

The interlock system generally comprises a plurality of manually operable switch elements, each of which represents a separate indicium of a code for energizing the interlock system. When the interlock system is so energized, it will enable operation of the vehicle. The interlock system is enabled, only when a plurality of the switch elements have been activated in proper sequence to conform to the preestablished sequence of indicia of this code.

The interlock system also comprises means operatively associated with the switch elements to generate an electrical signal in response to actuation of the switch elements. A plurality of electronic latches are connected in operative relationship to the switch elements. Specifically, each particular latch is connected in operative relation to one of the particular switch elements and in such arrangement that the latches are switched to an upper state to energize the enabling signal in response to the electrical signals, only when the switch elements are operated in the proper sequence. Again, this proper sequence is that which conforms to the pre-established sequence of indicia of the code. A solid state circuit component is associated with the electrical component and is connected to the output of the latches, so that it is operable in response to the enabling signal to thereby permit operation of the electrical component.

The present invention may further be characterized in that the solid state circuit component has a silicon-controlled rectifier. Moreover, the latches may each be comprised of a pair of gating elements with a pair of inverters located at the output of the gating elements. One of these inverters is biased to a first state, and the other inverter is biased to an opposite state, and when the switch elements are operated in the proper sequence to enable generation of the enabling signal.

The electrical component which forms part of the vehicle may adopt the form of the starter solenoid of the vehicle, or otherwise, a fuel pump, which is electrically operable, or any other component which is electrically operable and forms part of the engine system of the vehicle. In this case, the interlock system may be operable with more than one electrical component in the vehicle, as, for example, the starter solenoid and the fuel pump, or like component.

Each of the switch elements produces an electrical signal of duration equal to the time that any particular one of the switch elements is actuated. However, capacitor means are operatively connected to the outputs of these switch elements in order to compensate for the different durations of any electrical signals and also to compensate for any transients or noise therein.

The latches are preferably formed of gating elements as described above. Moreover, a pair of gating elements essentially comprise each of the latches, and these gating elements are cross-coupled. The gating elements are connected in a sequence, so that the first of the gating elements is biased to a set state and a second of the gating elements is biased to a reset state. The other gating elements in a first preestablished sequence are biased to a set state, and the remaining gating elements in a second preestablished sequence are biased to a reset state.

BRIEF DESCRIPTION OF THE DRAWINGS

Having thus described the invention in general terms, reference will now be made to the accompanying drawings, in which:

FIG. 1 is a front elevational view of a panel including a plurality of manually operable switches forming part of the safety interlock system of the present invention.

Figure 2:
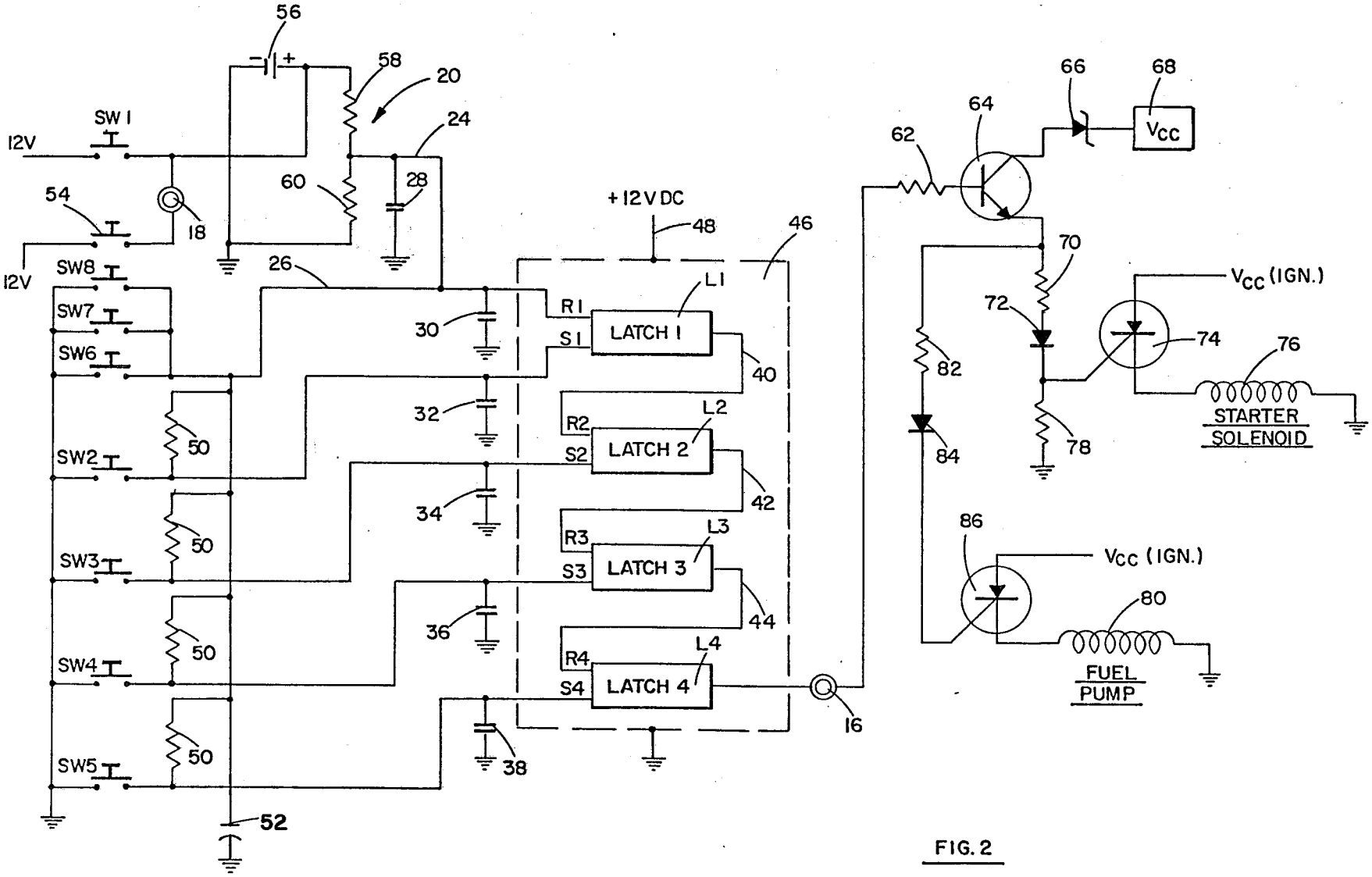

FIG. 2 is a schematic circuit view showing the general components of the safety interlock system forming part of the present invention.

Figure 3:
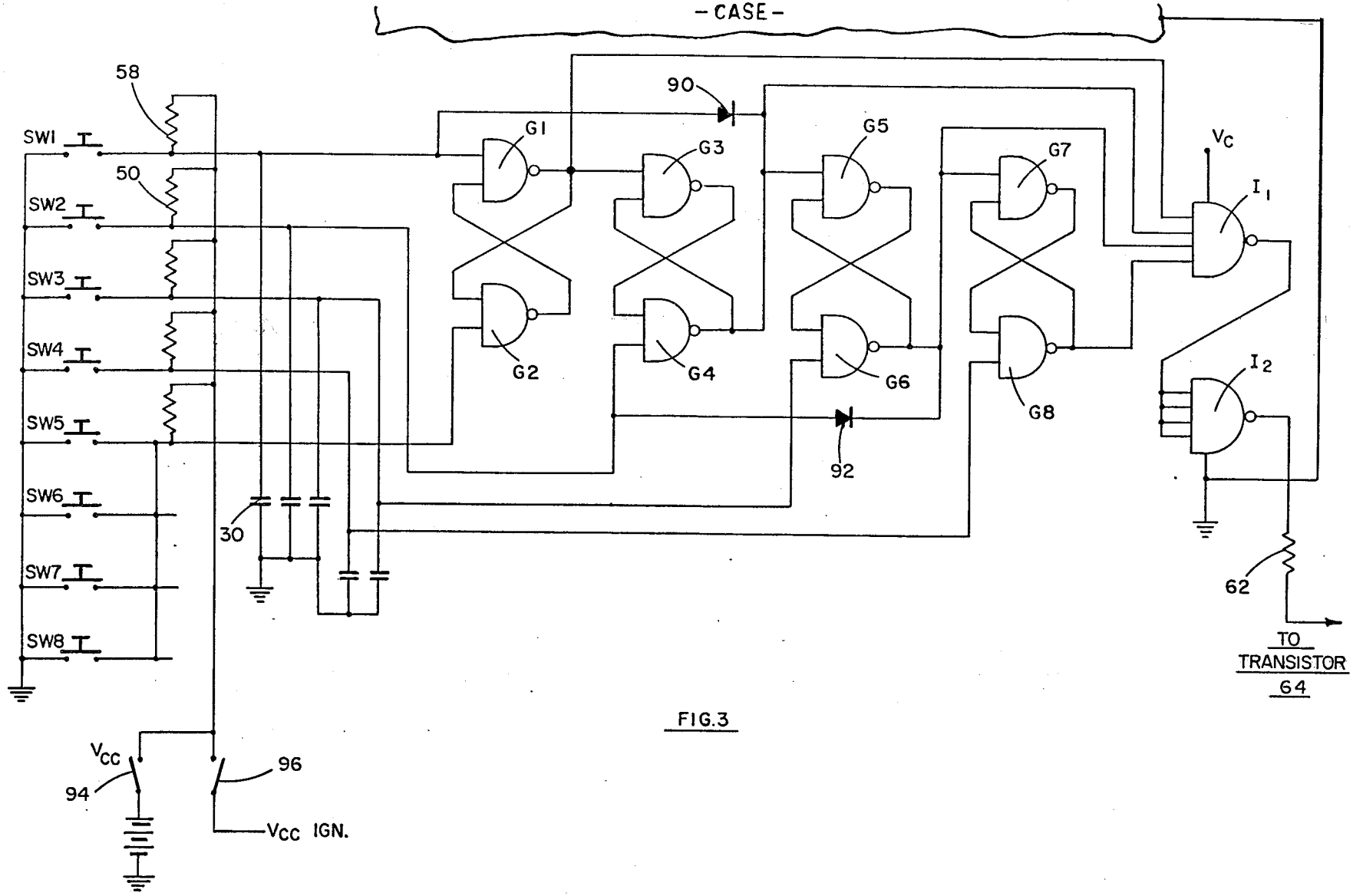

FIG. 3 is a schematic circuit view showing the gating system forming part of the latches used in the safety interlock system of the present invention.

FIG. 4 is a schematic circuit view of the electrical circuitry forming part of a delay timer used in the safety interlock system of the present invention.

FIG. 5 is a schematic view of a truth table for the latches used in the interlock system of the present invention.

DETAILED DESCRIPTION

Referring now in more detail and by reference characters to the drawings, A designates a safety interlock system which is constructed in accordance with and embodies the present invention, and which is specifically designed to be utilized in automotive vehicles and like devices. This safety interlock system is specifically designed to prevent theft or other unauthorized removal of automotive vehicles, although the interlock system could be used in a wide variety of applications, including the unauthorized removal of other forms of vehicles, e.g., boats, airplanes and the like. In addition, the interlock system could be uniquely designed to prevent unauthorized tampering with other devices by incorporation of the safety interlock system of the present invention.

The safety interlock system A of the present invention generally comprises a small casing 10, which may be mounted in a convenient location within the vehicle, as, for example, on the dashboard thereof. The casing 10 includes a face plate 12, with a plurality of manually operable push button switches. Only eight such switches are illustrated, and these particular switches are designated by code indicia 1 through 8, although it should be observed in connection with the present invention that any number of input switches may be employed. In addition, the face plate 12 is provided with a first light-emitting diode, or similar indicating light 16, which indicates that the switches of the system have been properly operated in sequence, in order to permit energization of the vehicle motor. A second light-emitting diode, or similar light source, 18, is also mounted on the face plate 12, which indicates that the safety interlock system has been termporarily bypassed, in a manner to be hereinafter described in more detail. Moreover, a main switch 19 may also be employed if desired and mounted on the face plate 12. This main switch 19 could be connected to the circuitry in a manner to permit energization or deenergization of the entire interlock system A.

Referring to FIG. 2 of the drawings, it can be observed that the eight push button switches are designated as $SW_1$, $SW_2 \ldots SW_8$. In this case, only five of the switches have been selected for introducing a five-digit input code, although any number of switches could be used for introducing the input code, that is, less than five or more than five switches may be used in order to generate the desired indicia code.

Each of the input switches is illustrated as push button switches, and these switches are preferably manually operable and generate an electrical signal only for the duration of the time that they are pressed. For this purpose the switches would be normally biased to the opened or "off contact" position. One terminal of each of these switches is connected to ground in the manner as illustrated in FIG. 2 of the drawings. In this case, the ground would adopt the ground condition of the engine-operated vehicle.

Since only five switches are effectively employed in this embodiment for generating the indicia code to open the interlock system, the remaining switches, 6–8, are not utilized. When these remaining switches are actuated, they will generate a reset signal in a manner as more fully illustrated in FIG. 2 of the drawings.

The first switch, $SW_1$, is connected through a time-delay circuit, 20, hereinafter described, to a reset input $R_1$ of a first latch designated as $L_1$. In this case, the three unused switches $SW_6$, $SW_7$ and $SW_8$ are also connected to the reset input of the latch $L_1$.

The output of the timing circuit 20 is introduced into the reset input $R_1$ of the latch $L_1$ over an output line 24. In like manner, the outputs of each of the switches $SW_6$, $SW_7$ and $SW_8$ are introduced into the reset input of the latch $L_1$, over an output line 26. A capacitor 28 is connected to the output line 24 and is grounded and a similar capacitor 30, and is connected to the output line 26 and is also grounded in the manner illustrated in FIG. 2. These capacitors 28 and 30 are more specifically designed to smooth out any spikes or noise which result from actuation of any of these particular switches. It can be observed that the switches are simple push button-operated switches, where the signal duration may be of any duration, depending upon the time that the operator holds the switches in the contact position. However, it has been found in connection with the present invention that it is not necessary to employ a Schmidt trigger, or any other form of multi-modulator, in order to eliminate pulses of different lengths resulting from holding the switches in the contact positions for different time periods. The capacitors 28 and 30 have been found to be highly effective in eliminating the noisy signals which would otherwise result therefrom.

The output of the switch $SW_2$ is introduced into the set input of latch $L_1$, previously described, and is also provided with a capacitor 32, similar to the capacitors 28 and 30, and which is designed to smooth the signal introduced into the set input of the latch $L_1$. The switch $SW_3$ has an output which is introduced into the set input of a second latch $L_2$, with a capacitor 34, functioning in the same manner as the previously described capacitors 28, 30 and 32. In like manner, the switches $SW_4$ and $SW_5$ have inputs into the second sets of latches $L_3$ and $L_4$, and each of these inputs similarly has capacitors 36 and 38, which are also grounded and function in the same manner as the previously described capacitors.

The latch $L_1$ has an output 40 which is introduced into the reset input for latch $L_2$. The latch $L_2$ also has an output 42 introduced to the reset input $R_3$ of the latch $L_3$. In like manner, the latch $L_3$ has an output 44 introduced into the reset input $R_4$ of the latch $L_4$.

The operation of each of these latches $L_1$–$L_4$ is more fully described hereinafter. However, it can be observed that these particular latches are available in the form of a single integrated circuit chip designated as 46 and which is provided with a positive 12-volt direct current input 48 and a grounded line, in the manner as illustrated in FIG. 2. Moreover, each of these latches $L_1$–$L_4$ effectively functions as a flip-flop, and each of these flip-flops is comprised of a plurality of NAND gates in a manner to be hereinafter described in more detail.

Each of the switches $SW_2$–$SW_5$ is provided with a resistor designated as 50 in its output and which is connected to ground through a capacitor 52. These resistors 50 effectively serve as "pull-up" resistors and operate in conjunction with the capacitor 52 which is capable of compensating for the capacitance in the lines to the various latches. These resistors 50 and the capacitor 52 are grounded in order to eliminate noise which is created in the supply voltage to the various latches.

The timing circuit 20 is designed so that the user of the system may permit energization of the electrical system to the motor of the vehicle by mere actuation of a switch 54. In this case, the switch 54 is also a manually operable push button switch in the same manner as the previously described switches SW.

The timing circuit 20 is comprised of a capacitor 56, which is connected in combination with a pair of resistors 58 and 60, in the manner as illustrated in FIG. 2. In essence, the switch $SW_1$, as well as the switch 54, is connected directly to the positive terminal of the capacitor 56. The negative terminal of this capacitor 56 is connected directly to the resistor 60, whereas the positive terminal is connected directly to the resistor 58. When a 12-volt input is introduced into the timing circuit 20, the capacitor 56 charges up and discharges effectively through the resistors 58 and 60. The RC timing factor, that is, the effective resistance in essentially the resistor 58, and the capacitor 56 determines the amount of time for discharge of the capacitor 56. In this respect, the capacitor 28 is designed to operate as a filter on the output signal from the timing circuit 20. In this way, the timing circuit effectively permits complete operation of the circuit by virtue of permitting the input in accordance with the desired code without enabling resetting of the various latches $L_1$–$L_4$.

Referring now to the arrangement of the latches $L_1$–$L_4$, as illustrated in FIG. 2, it can be observed that these latches are connected in such manner that the latch $L_4$ provides an enabling signal at its output in accordance with the truth table set forth in FIG. 5 of the drawings. In this case, the Q representation is that output from each of the latches $L_1$–$L_4$.

The actual operation of the latches $L_1$–$L_4$ is more fully described in connection with the gating circuit illustrated in FIG. 3 of the drawings. It can be observed from FIG. 5 of the drawings how the various latches operate in order to generate an enabling signal. When the switch $SW_1$ is actuated, the reset to the latch $L_1$ creates a "one" signal, and when the switch $SW_2$ is actuated a "zero" or set input is generated to the latch $L_1$. Accordingly, the output will have no change and will generate a "one" signal. When the switch $SW_2$ is actuated, the reset input to the latch $L_2$ will be a "one" signal and the set input will be a "zero" signal, and consequently the output of the latch $L_2$ is a "one" signal. In this way, the reset input to the latch $L_3$ will be a "one" input and the set input will be a "one" signal so that the output of the latch $L_3$ is a "zero" signal. Finally, when the switch $SW_5$ is actuated, the input to the latch $L_4$ is a "one" input and the set input is also a "zero" input so that the output Q of the latch $L_4$ is a "one" output. In this way, an enabling signal will be generated at the output of the latch $L_4$.

The output of the latch $L_4$ is connected to the light-emitting diode 16 in order to indicate when a correct coding has been introduced into the circuit by means of proper actuation of the various push button switches 14 in proper sequence. If this occurs, the light-emitting diode 16 will be energized. In like manner, the switch 54 is provided with the light-emitting diode 18 in its output line in order to indicate when the switch 54 has been actuated in order to energize the timing circuit 20. In accordance with the preferred aspect of the present invention, the switch 54 is located in an unobtrusive location, as, for example, under the dashboard or like portion of the vehicle. However, the light-emitting diode 18 would be on the base plate 12 as indicated in FIG. 1 of the drawings.

The output of the latch $L_4$ is introduced through a current-limiting resistor 62 into the base of an NPN transistor 64. The collector of this transistor is connected through a zener diode 66 to a 12-volt source of electrical current "$V_{cc}$," also designated as 68.

The emitter of the transistor 64 is connected through a resistor 70 and a diode 72 to the gate of a silicon-controlled rectifier 74, the rectifier 74 also receiving a 12-volt signal $V_{cc}$ from the ignition system of the electrical circuit forming part of the engine system of the vehicle. The output of the silicon-controlled rectifier 74 is thereupon connected to a starter solenoid coil 76, forming part of the engine of the vehicle, the opposite terminal of the coil being grounded in the manner as illustrated in FIG. 2. In addition, the diode 72 is connected through the resistor 78 to a ground terminal.

It can be observed that when a "high" or otherwise a "one" signal is present at the output of the latch $L_4$, the transistor 64 will be energized, thereby permitting current to pass through the diode 72 to the gate of the silicon-controlled rectifier 74. In this case, the diode 72 acts as a form of a buffer to protect the gate of the silicon-controlled rectifier 74. The zener diode 66 essentially serves to limit the input voltage to the collector of the transistor 64 to, for example, 10 volts, in order to further protect the gate of the silicon-controlled rectifier 74. In essence, the diode 72 prevents voltage from going back into the emitter of the transistor 74.

The interlock system of the present invention may also be connected to other electrically operable components of the vehicle, or, otherwise, to other components of the vehicle in addition to the starter solenoid. For example, in those vehicles which employ electrically operable fuel pumps which would schematically have a coil, as designated by reference numeral 80 in FIG. 2 of the drawings. In this case, the emitter of the transistor 64 is connected through a resistor 82 and a diode 84 to the gate of a silicon-controlled rectifier 86. This silicon-controlled rectifier 86 is, in turn, connected to one terminal of the fuel pump coil 80 and the opposite terminal of which is grounded. Again, the silicon-controlled rectifier 86 will control operation of the fuel pump coil 80 when energized, and the diode 84, along with the resistor 82, will protect the gate of the silicon-controlled rectifier 86 from excessive current levels.

In accordance with the above-outlined construction, it can be observed that each of the latches $L_1$–$L_4$ must be operated in sequence with respect to five correct push button switches which are operated in sequence. In this case, it has been arbitrarily established that the switches $SW_1$–$SW_5$ must be operated in proper sequence in order to operate each of the latches $L_1$–$L_4$. Thus, when each of these switches are so operated in the proper sequence, an enabling signal will be generated at the output of latch $L_4$ in order to permit the silicon-controlled rectifiers 74 and 86 to operate the electrical components of the vehicle. It can also be observed that if any one switch was pressed out of sequence, the particular latch associated therewith would be reset. Accordingly, the device would be inoperative until the sequence was again started such that all switches were operated in proper sequence in order to regenerate the enabling signal.

It should be observed that switches $SW_1$ through $SW_5$ were arbitrarily selected, and any five of the individual switches $SW_1$–$SW_8$ could be selected in an arbitrary random manner. Again, five individual switches have been selected for generating the proper input code, although this is also an arbitrary number of switches and any number thereof could be employed, as, for example-four, six or seven. In like manner, it could also be observed that if more switches are required in order to generate additional input code indicia, then additional latches would also be required. These additional latches would also be connected in the same manner as illustrated in FIG. 2.

The latches $L_1$–$L_4$ are primarily flip-flops as indicated above. Again, these flip-flops are comprised of a pair of NAND gates, and the actual operation with respect to the setting and resetting of these latches is hereinafter described in more detail, with reference to the particular NAND gates forming part of these latches.

FIG. 3 more fully illustrates the latches present in the form of NAND gates, and in this case it can be observed that the first latch $L_1$ is comprised of a pair of cross-coupled NAND gates $G_1$ and $G_2$. The output of the gate $G_1$ is introduced as an input to the gate $G_2$. In addition, the input to the gate $G_1$ is introduced to an inverting NAND gate $I_1$. In like manner, the output of the gate $G_1$ is connected to a gate $G_3$, and the output of this gate $G_3$ is connected to an input of a gate $G_4$ where the gates $G_3$ and $G_4$ form the second latch $L_2$. The third latch comprises gates $G_5$ and $G_6$ where the output of the gate $G_4$ is introduced as an input to the gate $G_5$. In addition, outputs of each of the gates $G_5$ and $G_6$ serve as inputs to the other of the gates. The latch $L_4$ is comprised of gates $G_7$ and $G_8$. The gates $G_7$ and $G_8$ also have outputs connected to the opposite of the gates and, in addition, the gate $G_7$ receives an input from the output of the gate $G_6$. Again, it can be observed that the gate $G_4$ has an output to the inverting NAND gate $I_1$ and the gate $G_6$ and the gate $G_8$ have outputs to the inverting NAND gate $I_1$. Finally, the inverting NAND gate $I_1$ has an output introduced into the four inputs of a second inverting NAND gate $I_2$. The output of this NAND gate $I_2$ is then introduced through the resistor 62 into the transistor 64, and the remaining portion of the circuit is identical.

With respect to FIG. 3, it can also be observed as to how the various input switches are connected to the NAND gates in order to introduce the set signals into these respective NAND gates. Moreover, it can also be observed, by reference to FIG. 3, that a ground line from the inverting NAND gate $I_2$ is connected to the case 10 in order to ground the case.

When all the four NAND gates, one from each of the respective four latches, are high, and introduce a "one" signal into the inverting gate $I_1$, this latter gate will become low. As this occurs, the output from the second inverting gate $I_2$ will become high. At the start, before any of the switches is actuated, all of the Gates $G_1$ through $G_8$ are in the reset position. When the output of gate $G_1$ becomes low, then the output of gate $G_2$ will become low. In this case, when the switches are actuated in proper sequence, gates $G_3$, $G_5$ and $G_7$ will become high, and gates $G_4$, $G_6$ and $G_8$ will become low. Thus, when the first gate $G_1$ is pulsed and goes high, not only does it cause the gate $G_2$ to become low, but also sends a "one" signal to the inverting gate $I_1$. The output of gate $G_3$ will hold gate $G_5$ in a low position.

Diodes 90 and 92 may also be interposed in the lines to the inputs of gates $G_5$ and $G_7$, in the manner as illustrated in FIG. 3. These diodes are designed to prevent holding all of the buttons down simultaneously in order to attempt to set all of the gates.

FIG. 3 also illustrates an overriding switch 94 which is connected directly to the battery of the vehicle, as opposed to a switch 96, which is connected to the ignition system of the vehicle. When the switch 94 is closed, the gates can remain in a set position since they are connected to a constant voltage source. Thus, this system is desirable in the event that the driver wishes to leave the automobile for use by an attendant, as, for example, in a parking lot, repair shop, or the like. The driver could always operate the vehicle so long as the switch 94 were closed, and so long as the operator did not attempt to actuate any of the push button switches. In the event that any of the push button switches was actuated, even with the override switch 94 closed, all gates would be shifted to the reset position, and the vehicle could only be started by introducing the proper code.

FIG. 4 illustrates a further time delay system which may be used in accordance with the system of the present invention. In this case, the time delay system is shown as being connected through switches $SW_5$ through $SW_8$ as illustrated. The time-delay system includes a gate 98, which has a capacitor 100 connected across a pair of resistors 102 and 104. In addition, a double-throw/double-pole switch 106 is provided as an input to the switch $SW_5$. Again, this sytem is designed to permit the use of the vehicle by an attendant without the necessity of using the code for opening the safety interlock system.

When the switch 106 is closed, the capacitor 100 will charge up and will discharge through the resistors 102 and 104 to the gate 98, depending upon the discharge rate of the capacitor 100. When the capacitor has been discharged below a certain level, the gate 98 will be shifted to a low condition and will thereupon reset all of the other gates $G_1$ through $G_8$. In essence, the timing permitted by this circuit is established by the RC factor of the capacitor 100 and the resistor 104. The resistor 102 does have some effect on this timing rate, although this resistor 102 effectively serves as a current-limiting resistor. Moreover, when the switch 106 is closed, the safety light 18 would be energized in order to advise the operator that the switch has been so closed.

While the latches $L_1$ and $L_4$ have been shown in the form of NAND gates, it should be observed that other forms of gating means could be employed, as for example NOR gates or the like. Moreover, it can be observed that the gates in each of the latches essentially establish a form of RS flip-flop, whereas other forms of flip-flops, including JK flip-flops, or the like, may be used. In essence, any form of logic gating may form part of these latches to operate the circuit of the present invention. In this respect, it should be noted that one of the important aspects is that the logic circuitry may be essentially separated from the input switches, and in this way it is virtually impossible for one to detect the code used in this system.

It can be observed in accordance with the present invention that the programable safety interlock system comprises a series of electronic latches, each of which is capable of being shifted between a set and a reset state. The latches are connected in such a way that the first latch in a series must be in a proper state before the next latch can be set or reset. When all of the latches have been set (or reset) in accordance with the preselected code and in the proper sequence, the current can then flow to the electrical component of the vehicle, such as the starter solenoid coil, the fuel pump, the electrically operable portion of the transmission, or other similar electrical component, or combination thereof. Once the latches generate an enabling signal to permit operation of the electrical component, the electrical circuitry controlling the current to this circuit will allow continual current flow as long as the engine is running, regardless of whether the lock is turned on or off. However, once the engine is shut off, the electrical component of the engine which is controlled by the safety interlock system cannot be again operated until the code has been introduced in the proper sequence.

One of the advantages of the system of the present invention is that the electronic components are quite small and can be packaged in a relatively small housing. This housing (not shown) can be located in any inaccessible location in the vehicle, as, for example, either in the passenger compartment or in the engine compartment. The switches which control the electronics are, however, located in the passenger compartment in close proximity to the driver's position.

After the operator of the system actuates the correct five push button switches in the proper sequence, the light-emitting diode 16 will be energized, which indicates that the vehicle is now in a proper operational condition. Thereafter, the operator may then start the car within the proper time-delay period, as established by the time-delay circuit 20, as, for example, 30 seconds. In the event that a thief or someone attempted to unauthorizedly remove the vehicle, it would almost be necessary to jack up the rear of the car in order to obtain access to the transmission or to jack up the front of the car in order to obtain access to the starter solenoid. It would then be necessary to remove the connector at this component and insert a new connector, and thereafter connect wires from this new connector to a voltage source. Thereafter, it would be necessary to bypass all of the normal locks and ignition guards on the vehicle.

While it is virtually impossible to guarantee that any vehicle is foolproof from the point of theft or other unauthorized removal, it has been well established that a thief will not attempt to steal a vehicle unless the vehicle can be quickly removed, as, for example, within a matter of several seconds, or at the longest several minutes. Accordingly, the safety interlock system of the present invention obviates almost all possible normal theft and other forms of normal unauthorized removal.

The system of the present invention is uniquely designed so that it can only respond to the proper code. The latches in the system are not responsive to or affected by large voltage changes in the vehicle power source, as, for example, the battery. In addition, the electronic components are not affected by electronic noise, as, for example, that noise created by horns, electronic ignitions, lights and the like. In the event that a thief or other person who would attempt to unauthorizedly remove the vehicle would cut any of the wires from the switch panel to the safety interlock system, the safety interlock system would immediately remain in the off position. Even if it were attempted to ground certain wires of the vehicle or add additional current, as, for example, from a "hot wire," to any or all of the wires of the system, the latches would still remain in the off condition.

The safety interlock system of the present invention will not affect normal maintenance of the vehicle and, more importantly, is so uniquely designed that it cannot possibly create any damage to the electrical system of the vehicle. Moreover, the system is so uniquely designed so that the customer can recode his own safety interlock system at any time. It is easy and convenient to recode the system by merely connecting any one of the switches $SW_1$ through $SW_8$ to any of the latches, as illustrated.

Thus, there has been illustrated and described a unique and novel safety interlock system which effectively prevents the theft or other unauthorized removal of a vehicle or similar electrically operable system. Accordingly, the safety interlock system of the present invention meets all of the advantages and objects sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention.

Having thus designed my invention, what I desire to claim and secure by letters patent is:

1. A safety interlock system to prevent theft or unauthorized removal of a vehicle having an engine system for powering said vehicle with an electrical component forming part of the engine system, said interlock system comprising:

(a) a plurality of manually operable switch elements, each representing a separate indicium of a code for energizing said interlock system to enable operation of said vehicle when a plurality of said switch elements have been actuated in proper sequence to conform to the pre-established sequence of indicia of said code, (b) means operatively associated with said switch elements to generate an electrical signal in response to actuation of said switch elements, (c) a plurality of gating elements, each of said gating elements being connected in operative relation to certain of said switch elements and in such arrangement that said gating elements are switched to a proper state to generate an enabling signal in response to said electrical signals only when said switch elements are operated in proper sequence to conform to the pre-established sequence of indicia of said code and thereby permit operation of said electrical component, and (d) a plurality position selection switch operatively connected to said switch elements and having a first position where the interlock system is operatively connected to a source of electrical power to operate said electrical component, said selection switch having a second position where said interlock system is operatively connected to said gating elements to hold said gating elements in a proper state in accordance with the switch elements being operated in proper sequence for a predetermined time period.

2. The safety interlock system of claim 1 further characterized in that a solid state circuit component is associated with the electrical component and being connected to the output of said gating elements and being operable in response to said enabling signal to thereby permit operation of said electrical component.

3. The safety interlock system of claim 1 further characterized in that a pair of inverters is located at the output of said gating elements with one of said inverters being biased to one state and the other of said inverters being biased to an opposite state when said switch elements are operated in proper sequence to enable generation of said enabling signal.

4. The safety interlock system of claim 1 further characterized in that each of said plurality of switch elements produce an electrical signal of duration equal to the time that any particular one of said switch elements is actuated, and capacitor means is operatively connected to the output of said switch elements to compensate for the different durations of any of said electrical signals and transients therein.

5. The safety interlock system of claim 1 further characterized in that said gating elements are connected in a sequence so that a first of said gating elements is biased to a set state and a second of said gating elements is biased to a reset state; certain of the other gating elements in a first pre-established response being biased to a set state and the remaining gating elements in a second pre-established sequence being biased to a reset state.

6. The safety interlock system of claim 1 further characterized in that said source of electrical power is a direct current source.

7. A safety interlock system to prevent theft or unauthorized removal of a vehicle having an engine system for powering said vehible with electrical component forming part of the engine system, said interlock system comprising:

(a) a plurality of manually operable switch elements, each representing a separate indicium of a code for energizing said interlock system to enable operation of said vehicle when a plurality of said switch elements have been actuated in proper sequence to conform to the pre-established sequence of indicia of said code, (b) means operatively associated with said switch elements to generate an electrical signal in response to actuation of said switch elements, (c) a plurality of electronic latches, each of said latches being connected in operative relation to certain of said switch elements and in such arrangement that said latches are switched to a proper state to generate an enabling signal in response to said electrical signals only when said switch elements are operated in proper sequence to conform to the pre-established sequence of indicia of said code, and (d) a plurality position selection switch operatively connected to said switch elements and having a first position where the interlock system is operatively connected to a direct current source of electrical power to operate said electrical component, said selection switch having a second position where said interlock system is operatively connected to said latches to hold said latches in proper state in accordance with the switch elements being operated in proper sequence for a predetermined time period.

8. The safety interlock system of claim 7 further characterized in that a solid state circuit component is associated with the elctrical components and is connected to the output of said latches, and being operable in response to said enabling signal to thereby permit operation of said electrical component.

9. The safety interlock system of claim 7 further characterized in that said solid state circuit component is a silicon-controlled rectifier.

10. The safety interlock system of claim 7 further characterized in that a pair of inverters is located at the output of said latches with one of said inverters being biased to one state and the other of said inverters being biased to an opposite state when said switch elements are operated in proper sequence to enable generation of said enabling signal.

11. The safety interlock system of claim 7 further characterized in that said electrical component is a starter solenoid of said vehicle.

12. The safety interlock system of claim 11 further characterized in that a second electrical component is operatively included in circuit controlling relation to said interlock system and is enabled simultaneously with enabling of said starter solenoid.

13. The safety interlock system of claim 7 further characterized in that each of said plurality of switch elements produce an electrical signal of duration equal to the time that any particular one of said switch elements if actuated, and capacitor means operating connected to the output of said switch elements to compensate for the different durations of any of said electrical signals and transients therein.

14. The safety interlock system of claim 7 further characterized in that said latches are comprised of a pair of cross-coupled gating elements.

15. The safety interlock system of claim 7 further characterized in that said gating elements are connected in a sequence so that a first of said gating elements is biased to a set state and a second of said gating elements is biased to a reset state, certain of the other gating elements in a first pre-established sequence being biased to a set state and the remaining gating elements in a second pre-established sequence being biased to a reset state.

16. The safety interlock system of claim 15 further characterized in that said gating elements are included in integrated circuit components.

17. The safety interlock system of claim 7 further characterized in that pairs of said latches comprise individual flip-flops.

18. The safety interlock system of claim 12 further characterized in that said second solid state circuit switching member is a silicon-controlled rectifier.

19. A method of using a safety interlock system to prevent theft or unauthorized removal of a vehicle having an engine system with an electrical component forming part of the engine system, said interlock system comprising:

(a) manually actuating a plurality of switch elements with each representing a separate indicium of a code for energizing the interlock system to enable operation of said vehicle when a plurality of said switch elements have been actuated in proper sequence to conform to the pre-established sequence of indicia of said code, (b) generating an electrical signal in response to actuation of said switch elements, (c) switching a plurality of gating elements to a proper state in response to said electrical signals only when said switch elements are operated in proper sequence to conform to the pre-established sequence of indicia of said code and with each of said gating elements being connected in operative relation to certain of said switch elements and in such arrangement that said gating elements are switched to the proper state when the switches are actuated in proper sequence, to thereby permit operation of said electrical component, and (d) actuating a plurality position selection switch operatively connected to said switch elements and having a first position, said interlock system being operatively connected to a direct current source of electrical power to operate said electrical component upon shifting said selection switch to said first position, said selection switch having a second position where said interlock system is operatively connected to said gating elements being operated in proper sequence for a predetermined time period upon shifting said selection switch to said second position.

20. A safety interlock system to prevent theft or unauthorized removal of a vehicle having an engine system for powering said vehicle with first and second electrical components forming part of and necessary for starting or operation of the engine system, said interlock system comprising:

(a) a plurality of manually operable switch elements, each representing a separate indicium of a code for energizing said interlock system to enable operation of said vehicle when a plurality of said switch elements have been actuated in proper sequence to conform to the pre-established sequence of indicia of said code, (b) means operatively associated with said switch elements to generate an electrical signal in response to actuation of said switch elements, said switch elements and said last named means to generate an electrical signal being located in proximity to the operator position of said vehicle, (c) a plurality of electronic latches, each of said latches being connected in operative relation to certain of said switch elements and in such arrangement that said latches are switched to a proper state to generate an enabling signal in response to said electrical signals only when said switch elements are operated in proper sequence to conform to the pre-established sequence of indicia of said code, (d) a first solid state circuit member directly connected to the first electrical component and being connected to the output of said latches, and being operable in response to said enabling signal to actuate said first solid state circuit member and thereby permit operation of said first electrical component, (e) a second solid state circuit switching member directly connected to the second switching member directly connected to the second electrical component and being connected to the output of said latches and being operable in response to said enabling signal to actuate said second solid state circuit member essentially simultaneously with the first circuit member and thereby permit operation of said second electrical component, said latches and solid state circuit member being located in said vehicle remote to the operator's position and in a relatively inaccessable location in said vehicle, and (f) actuating a plurality position selection switch operatively connected to said switch means and having a first position, said interlock system being operatively connected to a direct current source of electrical power to operate said electrical component upon shifting said selection switch to said first position, said selection switch having a second position where said interlock system is operatively connected to said latches to hold said latches in proper state in accordance with the switch elements being operated in proper sequence for a predetermined time period upon shifting said selection switch to said second position.

21. The safety interlock system of claim 20 further characterized in that said first and second solid state circuit members are silicon-controlled rectifiers.

22. The safety interlock system of claim 21 further characterized in that said first electrical component is a starter solenoid of said vehicle.

23. The method of claim 20 further characterized in that said method comprises locating said switch elements in proximity to the operator position of the vehicle and the latches and switching members in a position remote to the operator position.

* * * * *